US007555859B1

(12) United States Patent
Kvortek

(10) Patent No.: US 7,555,859 B1
(45) Date of Patent: Jul. 7, 2009

(54) ELEVATED SIGN SYSTEM WITH GROUND LEVEL SIGN CHANGE-OUT CAPABILITY

(75) Inventor: David V. Kvortek, New Kensington, PA (US)

(73) Assignee: Matthews Resources, Inc., Wilmington, DE (US)

( * ) Notice: Subject to any disclaimer, the term of this patent is extended or adjusted under 35 U.S.C. 154(b) by 212 days.

(21) Appl. No.: 11/825,259

(22) Filed: Jul. 3, 2007

(51) Int. Cl.
*G09F 7/00* (2006.01)

(52) U.S. Cl. ..... 40/601; 40/491

(58) Field of Classification Search ..... 40/488, 40/491, 601; 248/132, 161, 225.11, 244, 248/297.21, 298.1, 222.41, 223.21, 221.12
See application file for complete search history.

(56) References Cited

U.S. PATENT DOCUMENTS 3,710,096 A * 1/1973 McFarlin ..... 248/27.1
3,958,349 A 5/1976 Nidelkoff
4,009,532 A 3/1977 Thomas
4,329,800 A 5/1982 Shuman
5,701,695 A 12/1997 Current
6,003,697 A * 12/1999 Ferchat et al. ..... 211/189
6,023,867 A 2/2000 Gagne
6,470,611 B1 10/2002 Conway
7,451,955 B2 * 11/2008 Teramachi et al. ..... 248/223.41

* cited by examiner

*Primary Examiner*—Joanne Silbermann
(74) *Attorney, Agent, or Firm*—R. S. Lombard

(57) ABSTRACT

A sign system particularly useful for point of purchase advertising that is elevated above the reach of shoppers. A slideable sign frame assembly carrying a sign is slideably attached to a normally hidden sign frame assembly supporting apparatus. The sign frame assembly and the supporting apparatus both carry pairs of cooperating slots of predetermined dimensions and configuration that together with a plurality of bolts, one for each slot, provide for the sign frame assembly and the supporting apparatus to be physically connected to one another while at the same time permit movement of the sign assembly relative to the supporting apparatus in the vertical direction. The bolts in cooperation with associated slots permit the raising and lowering of the sign assembly for change-out of the sign from ground level. A sign change-out tool is used to raise and lower the sign assembly.

20 Claims, 12 Drawing Sheets

ELEVATED SIGN SYSTEM WITH GROUND LEVEL SIGN CHANGE-OUT CAPABILITY

BACKGROUND OF THE INVENTION

The present invention relates to a sign system, and, in particular, to a sign system including a sign useful in point of purchase advertising that is elevated above the reach of shoppers, and is used at convenience stores, supermarkets, department stores, home supply stores and the like. Such signs being mounted above the reach of most employees, pose a safety concern when it is time to change the sign. Changing the sign usually requires the use of a ladder, which as is well known, provides a risk of collapsing or falling over when the user is near the top of the ladder. Employers and insurers are naturally concerned with the safety risks posed by the use of a means such as a ladder to perform the sign change-out task. The sign system of the present invention has an integral vertical adjustment structure, that is substantially hidden when the sign is in the operative display position and only becomes visible to a consumer or bystander during change-out of the sign and is therefore aesthetically pleasing to the consumer or bystander.

Various sign systems with integral vertical adjustment capability have been disclosed in the past, such as U.S. Pat. No. 5,701,695, dated Dec. 30, 1997, issued to Wayne A. Current. The Current patent discloses a free-standing device for displaying a sign at various heights and includes a sign holder and a base. The sign holder includes a framed transparent window with hollow frame members disposed along the lateral sides. The base includes upwardly extending support rods for frictionally and slideably engaging the hollow interior of the frame member. The sign holder and sign are selectively maintained at various heights along the support rod. Upon lowering the support rods they are completely hidden with the hollow frame member.

Another such sign system, is disclosed in U.S. Pat. No. 6,470,611 B1, dated Oct. 29, 2002, issued to Thomas M. Conway. The Conway patent discloses a two-position vertically adjustable sign system used for mounting display media to an associated vertically oriented rack or shelf. The Conway system permits by its vertical adjustable capability provision for access to the shelves on which the sign system is mounted for restocking or storage.

In U.S. Pat. No. 3,958,349, dated May 25, 1976, issued to James G. Nidelkoff, is disclosed a support for a screen printed transparency or other photographic art work which may be raised on a track from a lowered ground position by a workman by use of a rod to engage a hook attached to a slideable frame affixed to a telescopic support to raise it into an upper position in a frame mounted on an elevated illuminated signboard. The support is fixed in the frame on the elevated signboard when raised.

Another such sign system is disclosed in U.S. Pat. No. 4,009,532, dated Mar. 1, 1977, issued to Wayne A. Thomas. The Thomas patent discloses a display stand for a sheet-like display member which is folded to provide a top edge fold and confronting side panels having adjacent lower edges. The display member is supported in an elevated position by an upstanding rod-like structure arranged to extend between lower edges of the panels and at its upper end fold. The lower end of the rod-like structure is arranged for adhesively mounting upon a surface of display container, carton, and the like. The rod-like structure comprises two elements which have axially adjustably interconnected overlapped end portions to permit adjustable variation of the supported height of the display member above the container.

Yet another such sign system is disclosed in U.S. Pat. No. 4,329,800, dated May 18, 1982, issued to Bernard E. Shuman. The Shuman patent discloses a lightweight display device capable of vertical adjustment to the desired height having a display frame attached to one end of a rod whose other end is formed from a pair of resilient arms having a plurality of teeth for the outer surface. The rod is positioned for ratchet-like vertical movement within a hollow tube having a threaded inner surface which engages the teeth. The frame can be raised or lowered, along the length of the rod, by extending a vertical force thereto sufficient to deflect the arms of the rod away from the threads of the tube. When the vertical force is removed, the teeth re-engage with the threads to support the display frame. The tube is mounted to a ground level base.

In U.S. Pat. No. 7,121,029 B2, dated Oct. 17, 2006, to David Wilson is disclosed a sign system provided with a hoisting mechanism for moving a sign between an access or servicing position near ground level and an elevated position. The sign system includes first and second sets of guide members and a drive system. The guide members are connected together for telescopic movement. The drive system includes a cable for raising and lowering a sign so that it may be changed at ground level.

Point of purchase sign display users such as, convenience stores, supermarkets, department stores, discount merchandisers, home supply stores and the like, in recent years have become quite concerned with making a positive effect on the consumer with regard to such sign displays upon entering the user's premises. Visual additional support poles and cables, and the like, are often not desirous, for displaying the user's point of purchase signs, but at the same time such users are very concerned with the safety of their employees while changing such sign which are often in an elevated positioned as mentioned. The foregoing prior art provides various integrally adjustable sign systems, which are either quite complex, or are for a different purpose, and apparently maybe somewhat difficult to use, or do not provide the aesthetic appeal such users demand.

SUMMARY OF THE INVENTION

The present invention provides an elevated sign system including a sign useful in point of purchase advertising, that is aesthetically pleasing in the operative display position, but includes substantially hidden integral vertical adjustment structure that provides safe and easy lowering capability and controlled stable movement for ground level "low" sign change-out without the use of a ladder or the like.

The elevated sign system of the present invention preferably includes a slideable sign frame assembly, which preferably includes a sign frame which may be a rectangular rigid back plate having integral sign retaining lips proximate the periphery of the back plate extending from the front of the back plate. One of the sign retaining lips is provided with a sign receiving slot.

A sign frame assembly supporting apparatus to be attached to a support such as a wall or pole is provided. The sign frame assembly supporting apparatus in the preferred embodiment includes a pair of parallel vertical elongated hollow sign frame assembly securing sections spaced at a predetermined distance from each other. Preferably the hollow securing sections have a substantially rectangular cross-section, but other designs are feasible such as oval or circular cross-sections, for example. The sign frame securing sections are of predetermined dimensions and preferably have a length that is somewhat less than the vertical dimension of the sign frame assembly, so the securing sections are hidden by the sign frame assembly when the sign system is in the operative high display position.

Attaching means is included for slideably attaching the sign frame assembly to the sign frame assembly supporting apparatus. The attaching means may include for example, first bolts or pins and second bolts or pins, or the like. The attaching means may also include first and second washer members of predetermined thickness carried by the first bolts.

In a preferred embodiment the rigid back plate of the sign frame assembly has a pair of substantially vertical parallel sign frame assembly first bolt retaining and cooperating guide slots, spaced at a predetermined distance from each other. Each of the sign frame assembly first bolt retaining and cooperating guide slots at the bottom thereof having a truncated V-shaped docking and locking portion. The locking portion of the V-shaped docking and locking portions of the first bolt retaining and guide slot is upwardly retroverted at a predetermined angle from the vertical portion of the first bolt retaining and cooperating guide slot proximate the bottom of the first slot.

The rigid back plate in one embodiment may have a pair of second bolt receiving apertures therethrough proximate the upper portion thereof.

In a preferred embodiment each of the parallel vertical sign frame assembly securing sections has a substantially vertical elongated sign frame assembly second bolt retaining and cooperating guide slot therein of predetermined length. Each of the second bolt retaining and guide slots at the top thereof has an inverted truncated V-shaped docking and locking portion. The locking portion of the inverted V-shaped docking and locking portion of the second bolt retaining and guide slot is preferably of predetermined length and is downwardly retroverted at the predetermined angle of the first bolt retaining and guide slot from the vertical portion of the second bolt retaining and guide slot at the top of the second slot. Preferably, the length of the operative vertical portions of the first bolt retaining and guide slots and the vertical portions of the second bolt retaining and guide slots are substantially equal. Additional preferred configurations of the first and second bolt retaining and guide slots are subsequently disclosed.

Each of the sign frame assembly securing sections' second bolt retaining and cooperating guide slots proximate the bottom thereof having a circular sign frame assembly second bolt insertion aperture.

A sign sized to slide through the sign receiving slot of the one retaining lip of the back plate and engaging the sign retaining lips near the front of the sign assembly is provided.

A sign change tool receiving member is desirably included and is centrally attached near the bottom back of the rigid back plate. A first angle stop bumper member is centrally attached proximate the upper portion of the back of the rigid back plate.

Desirably for stability of the system and ease in transporting and mounting it to a support, frame securing section connecting means including a plurality of brackets. A first bracket is attached between the top portions of the sign frame securing sections and a second bracket is attached between the bottom portions of the sign frame securing sections.

Preferably, the sign frame assembly securing sections each have a pair of first bolt receiving members or tabs that are attached oppositely from one another at the outer sides of the sign frame assembly sections. Each of the first bolt receiving members has first bolt receiving apertures therethrough. The first bolt receiving members may be threaded at the first bolt receiving apertures, for example, to operably engage the first bolts.

A third bracket is desirably attached between the sign frame securing sections proximate the lower portions thereof. A second angle stop bumper member is operatively attached to the third bracket.

Each of the first bolts having a pin portion sized to pass through the first bolt retaining and cooperating guide slots at the front of the back plate. Each of the first bolts has a head portion sized to prevent the head portion from passing through the first bolt retaining and guide slots. The pin portions of the first bolts operatively engaging the threaded first bolt receiving members.

Each of the second bolts having a second pin portion sized to pass through one of the second bolt slots and has a head portion sized to prevent it from passing through the second bolt slots. The second pin portion of the second bolts proximate the end thereof may be attached in predetermined position to the back plate by welding, or the second pin portion may be threaded for engagement of a nut, for example.

A sign change frame assembly engagement tool means is provided for operatively engaging the sign change-out tool receiving member which in a preferred embodiment is hollow.

Preferably, the sign frame assembly also includes a slideable sign backing panel sized to slide through the receiving slot and positioned adjacent to the back of the sign. Also, the sign frame assembly further includes spacer members of predetermined thickness attached to or in contact with the back of the sign backing panel in predetermined position. The spacers provide clearance for the first bolts to easily move as desired in the first bolt retaining and cooperating guide slots. The sign backing panel keeps the sign away from any contact with the first bolts. Preferably, the slideable sign backing panel is made of a plastic material, so that there is little friction between the backing panel and the first bolts. In a preferred embodiment the slideable sign backing panel is comprised of corrugated polyurethane material.

The sign change-out tool desirably includes an upper U-shaped sign assembly engagement portion, and a handle of predetermined length is attached to the U-shaped sign assembly engagement portion of the sign change-out tool. The sign change-out tool is used when it is desired to change the sign by a person standing at ground or floor level to reach the sign frame assembly without the need of standing on a ladder.

Preferably, the sign frame assembly further includes a windbreaker flap affixed to the one sign retaining lip proximate the periphery of the sign receiving slot.

In the configuration where for support, the sign system is to be attached to a vertical pole, the sign frame supporting apparatus further includes a vertical pole mounting bracket attached to the first bracket and operably attaching the sign frame supporting apparatus to the vertical pole.

BRIEF DESCRIPTION OF THE DRAWINGS

For a better understanding of the invention, reference may be had to the accompanying drawings exemplary of the invention in which.

DESCRIPTION OF THE PREFERRED EMBODIMENTS

Figure 1:
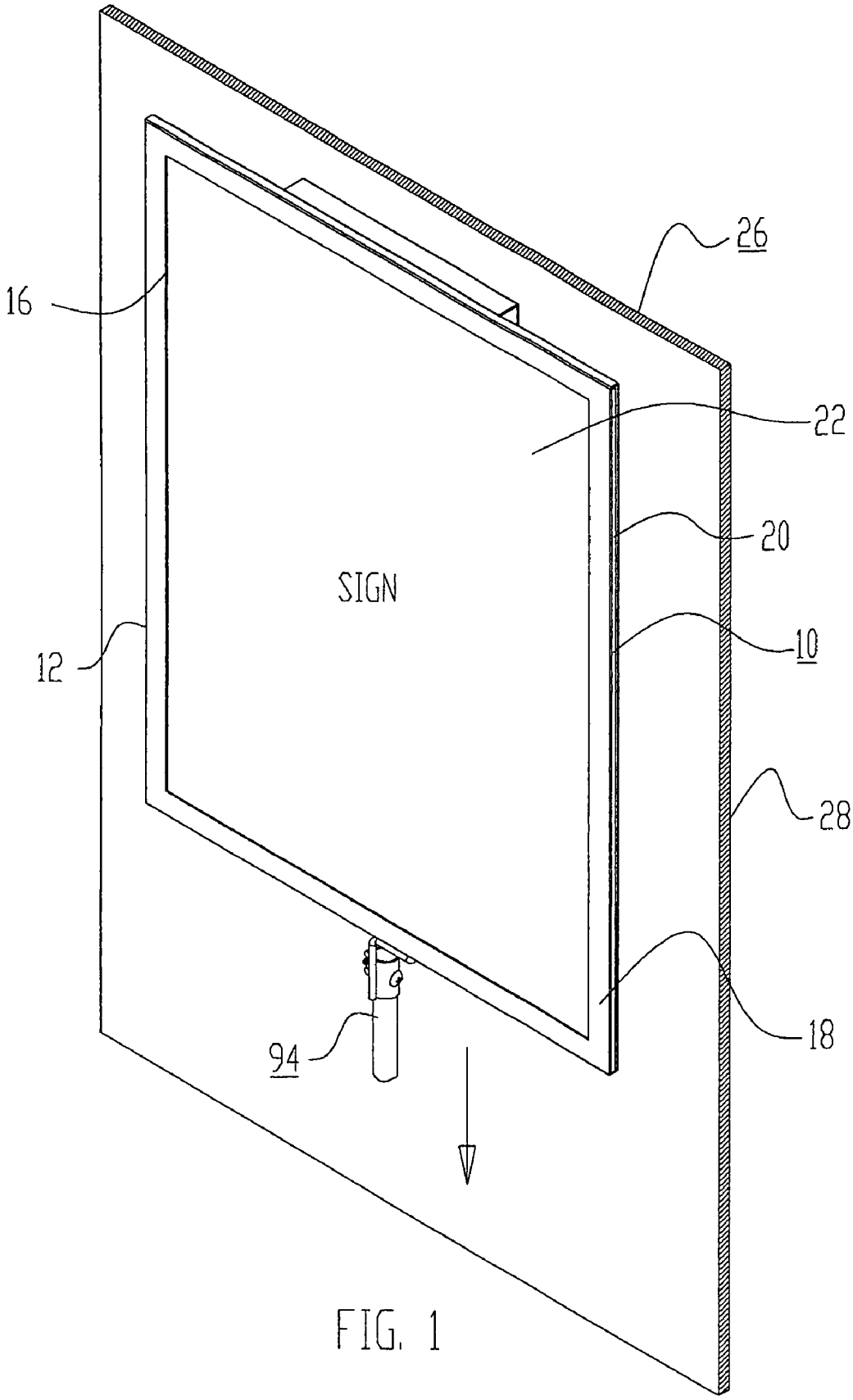
FIG. 1 is a perspective view of the elevated sign system of the present invention in the high display position affixed to a wall.
Figure 2:
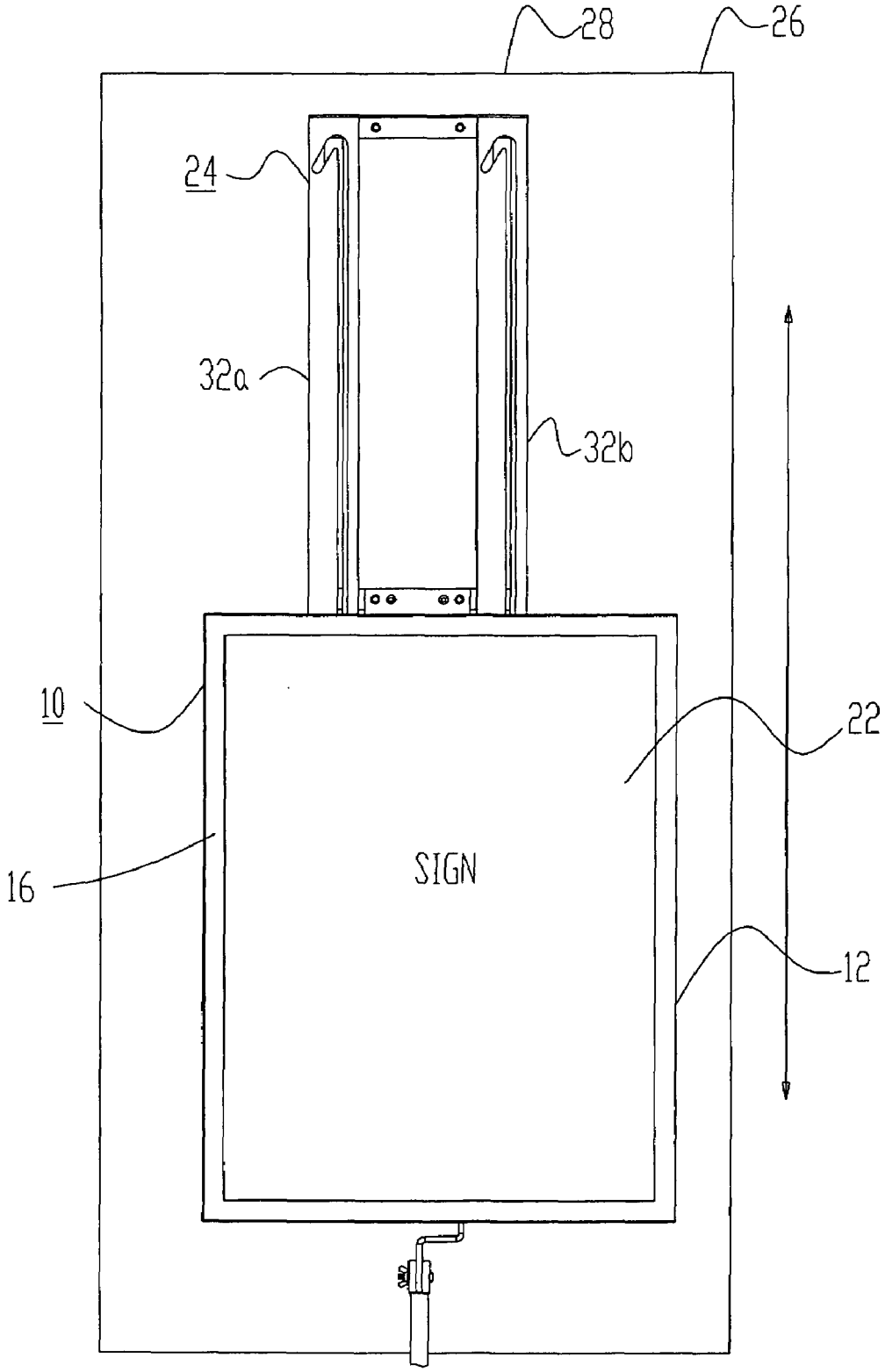
FIG. 2 is a front elevation view of the sign system in the low change-out position.
Figure 3:
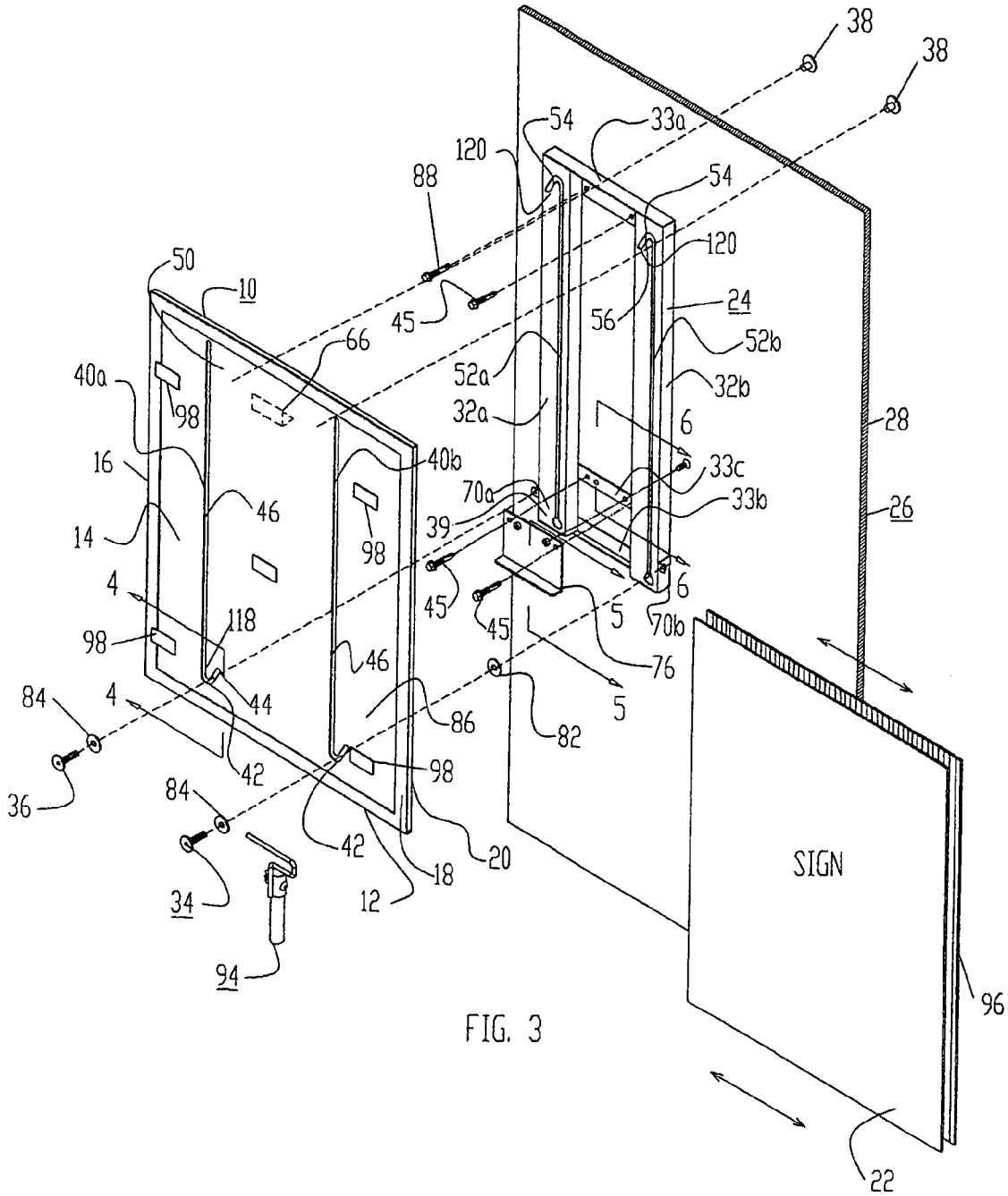
FIG. 3 is a perspective exploded view of the elevated sign system shown in FIG. 1.

With reference to FIGS. 1-3 one embodiment of the elevated sign system 10 is depicted. The elevated sign system 10 has a high display position as shown in FIG. 1 and may be lowered to a low sign change-out position as shown in FIG. 2. The elevated sign system of the present invention provides easy and safe lowering capability and controlled stable movement.

Figure 4:
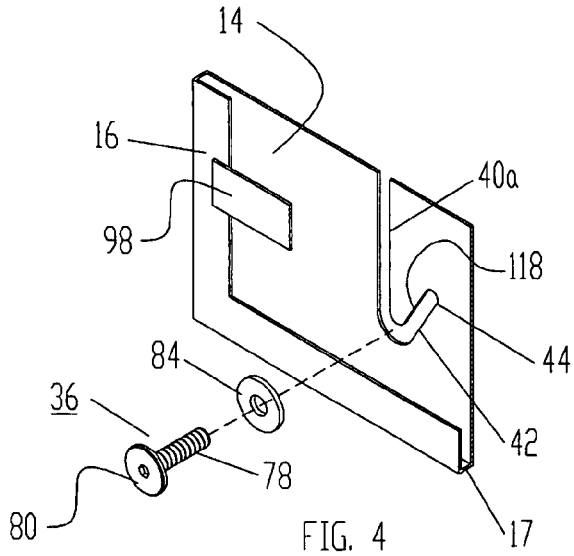
FIG. 4 is a partially exploded cross-sectional view taken along the line 4-4 of FIG. 3.
Figure 5:
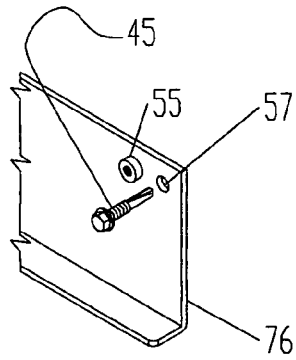
FIG. 5 is a partially exploded cross-sectional view taken along the line 5-5 of FIG. 3.
Figure 6:
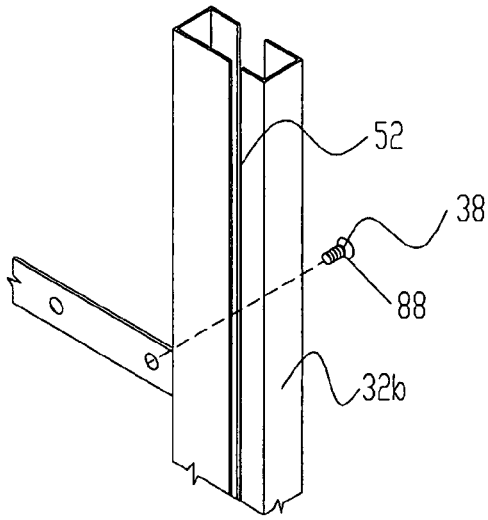
FIG. 6 is a partially exploded cross-sectional view taken along the line 6-6 of FIG. 3.

The sign system 10 includes a slideable sign frame assembly 12, including a rigid back plate 14 which can be made of metal, such as aluminum, for example. The rigid back plate 14 has integral sign retaining lips 16 around the periphery of the back plate 14, as shown in FIG. 4. The sign retaining lips 16 may have an inverted substantially L-shaped cross-section 17, as shown in FIG. 4, for example. One of the retaining lips 18 has a sign receiving slot 20 therein of predetermined dimensions for receiving a sign 22. The sign 22 is sized to slide through the sign receiving slot 20 and is retained in place by the sign retaining lips 16 at the front of the sign frame 12. The sign 22 may be used for point-of-purchase advertising and typically displays a written message or graphic or combination of both. The sign 22 may be made of any suitable material such as corrugated white plastic, for example.

Figure 22:
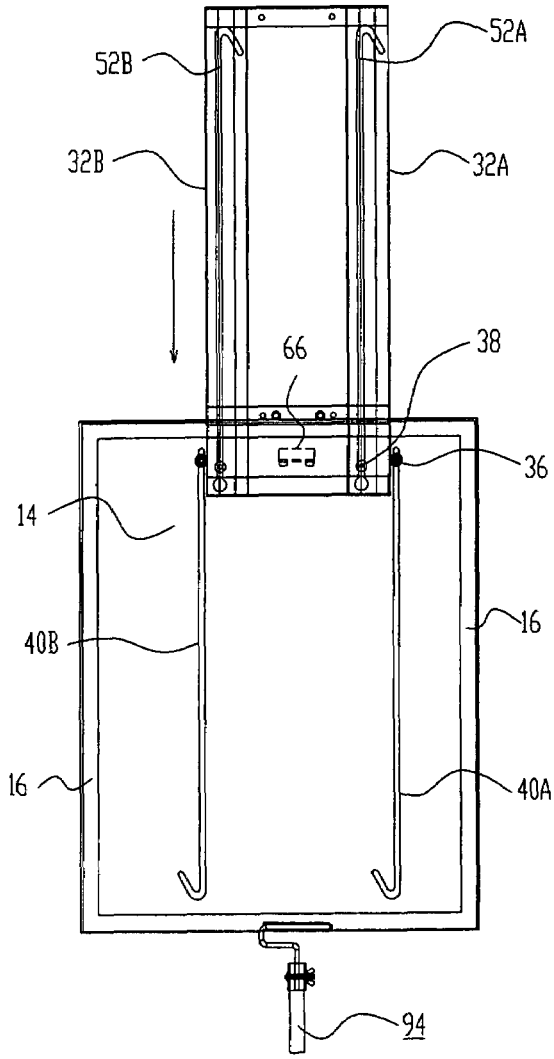
FIG. 22 is a rear elevation schematic view of the sign frame assembly lowered to the low change-out position, the first bolts and second bolts are in their final change-out position in the respective vertical portions of the first and second bolt retaining and cooperating guide slots.
Figure 23:
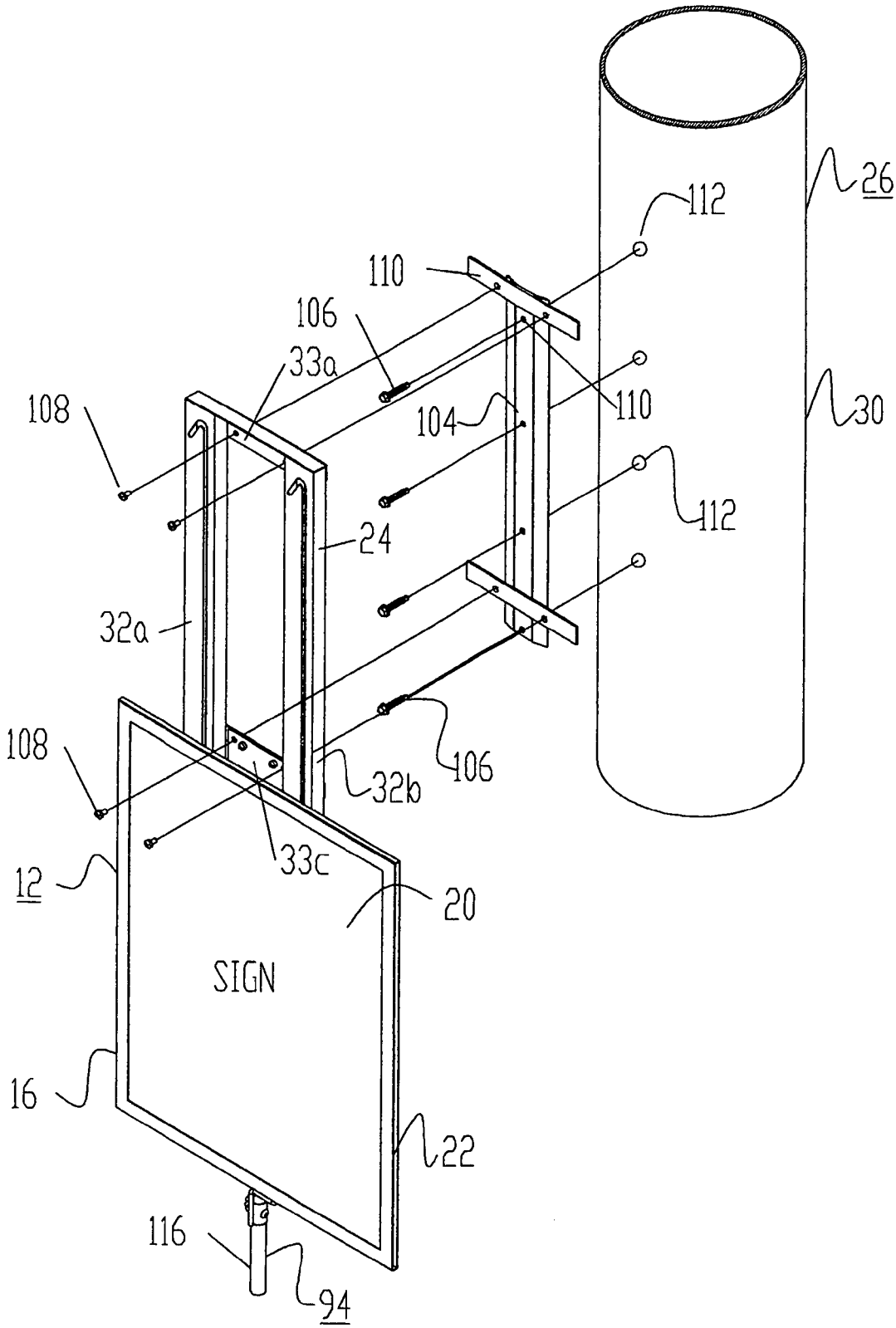
FIG. 23 is an exploded perspective view an embodiment of the sign system of the present invention for attachment to a pole where the sign frame assembly supporting apparatus includes a vertical pole mounting bracket and associated hardware.

A sign frame assembly supporting apparatus 24 is provided as shown in FIGS. 2, 3, 7-9, and 12-23. The sign frame assembly 24 is attached to a support 26, which in one embodiment may be a vertical wall 28, as shown, for example, in FIG. 1, or may, in a second embodiment may be a pole 30, as shown in FIG. 23. The sign frame assembly supporting apparatus 24 includes a pair of parallel vertical elongated hollow sign frame assembly securing sections 32*a*, 32*b*, as shown in FIG. 2, for example. The sign frame assembly securing sections 32*a*, 32*b* are spaced at a predetermined distance from each other such as 11 inches center to center. Sign frame securing section connecting and supporting brackets 33*a*, 33*b* and 33*c* are preferably included. The first bracket 33*a* is attached between top portions 37 of the sign frame securing sections 32*a*, 33*b* and the second bracket 33*b* is attached between the bottom portions 39 of the sign frame securing sections 32*a*, 32*b*, as shown if FIG. 17. A third bracket 33*c* is attached between the sign frame securing sections 32*a*, 32*b* near the lower portions thereof, above second bracket 32*b*. First bracket 33*a* and third bracket 33*c* have bracket apertures 41 passing therethrough, bolts 45 attach the first bracket 33*a* and the third bracket 33*c* to the wall 28, as shown in FIG. 3.

Attaching means 34 is provided for slideably attaching the sign frame assembly 12 to the sign frame assembly supporting apparatus 24. The attaching means 34 includes first bolts 36 and second bolts 38.

The rigid back plate 14 of the sign frame assembly has a pair of substantially vertical elongated parallel sign frame assembly first bolt retaining and cooperating slots 40*a*, 40*b* spaced at a predetermined distance which is greater than the horizontal distance between the outside edges of the securing sections 32*a*, 32*b*. Each of the sign frame assembly first bolt retaining and cooperating slots 40*a*, 40*b* at the bottom thereof has a truncated V-shaped docking and locking portion 42. The locking portion 44, such as shown in FIGS. 3 and 4, of the V-shaped docking and locking portions of the first bolt retaining slots 40*a*, 40*b* are upwardly retroverted as shown at a predetermined angle, such as from about 20 degrees to about 40 degrees, with 30 degrees being preferred, from the vertical portion 46 of first slots 40*a*, 40*b* at the bottoms of the slots 40*a*, 40*b*.

Figure 12:
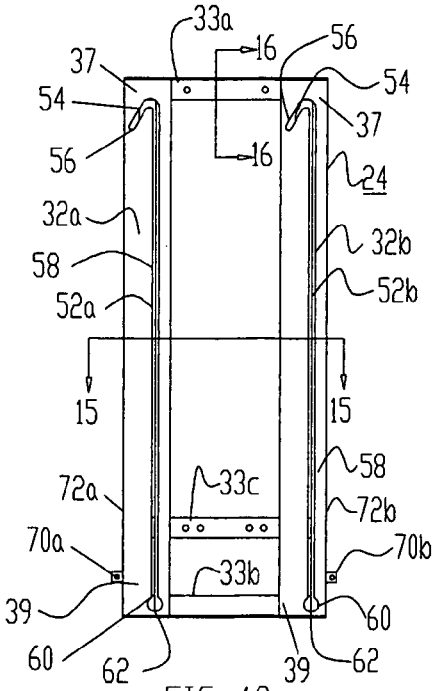
FIG. 12 is a front elevation view of the sign frame assembly supporting apparatus of the present invention.
Figure 14:
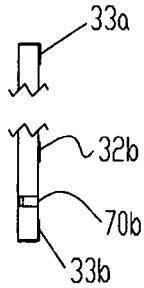
FIG. 14 is a right side elevation view, partially broken away, of the sign frame assembly supporting apparatus as shown in FIG. 12.
Figure 13:
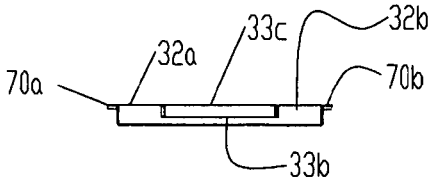
FIG. 13 is a bottom view of the sign frame assembly supporting apparatus as shown in FIG. 12.

The parallel vertical sign securing sections 32*a*, 32*b* each have a substantially vertical elongated frame assembly second bolt retaining and cooperating guide slot 52*a*, 52*b* of predetermined vertical length, such as 25 inches, for example. Each of the second bolt retaining and cooperating guide slots 52*a*, 52*b* having inverted truncated V-shaped docking and locking portions 54, as shown in FIG. 12. The locking portions 56 of the V-shaped docking and locking portions 54 of the second slots 52*a*, 52*b* have a predetermined length such as 1 inch, or about 1/25 of the vertical length of second slot 52*a*, 52*b*. The locking portions 56 of the V-shaped docking and locking portions 54 are downwardly retroverted as shown in FIG. 12, for example, from the vertical portion 58 of second slots 52*a*, 52*b*, at the same angle as described for the locking portion 44 of the first slots 40*a*, 40*b*, at the top the second slots 52*a*, 52*b*.

Each of the sign frame assembly securing sections 32*a*, 32*b* at the bottom 60 have a sign frame assembly second bolt insertion aperture 62 for receiving second bolts 38, as shown in FIG. 12.

Figure 7:
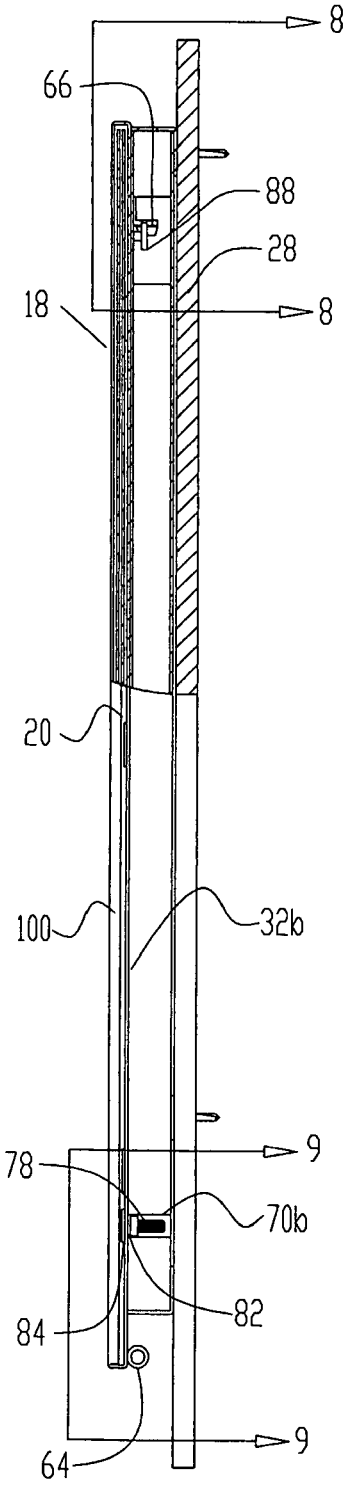
FIG. 7 is side-elevation view, partially in section, of the sign system shown in FIG. 1.
Figure 8:
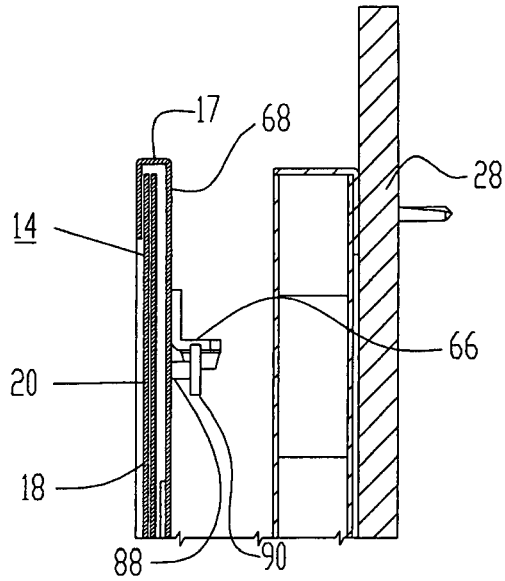
FIG. 8 is a cross-sectional view taken along the line 8-8 of FIG. 7.
Figure 9:
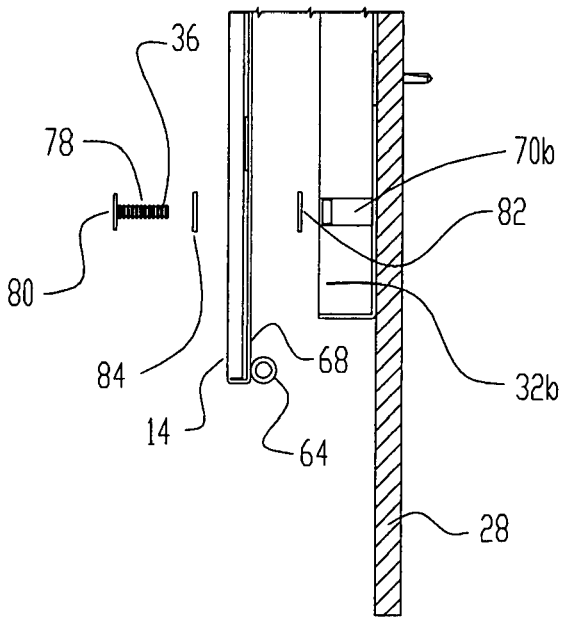
FIG. 9 is a cross-sectional view taken along the line 9-9 of FIG. 7.
Figure 10:
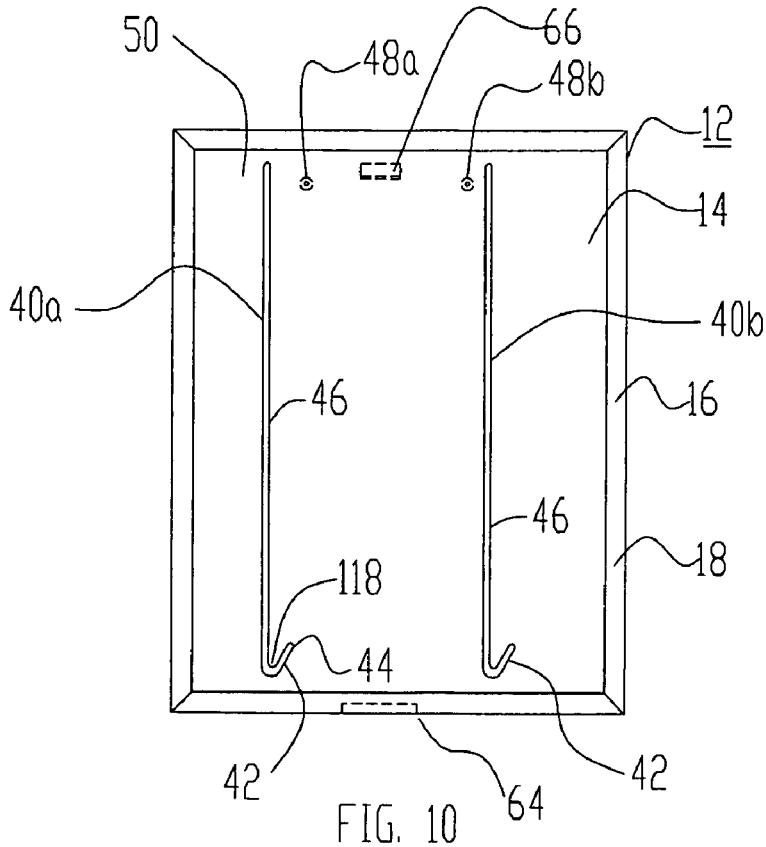
FIG. 10 is a front elevation view of the slideable sign frame assembly of the present invention.
Figure 11:
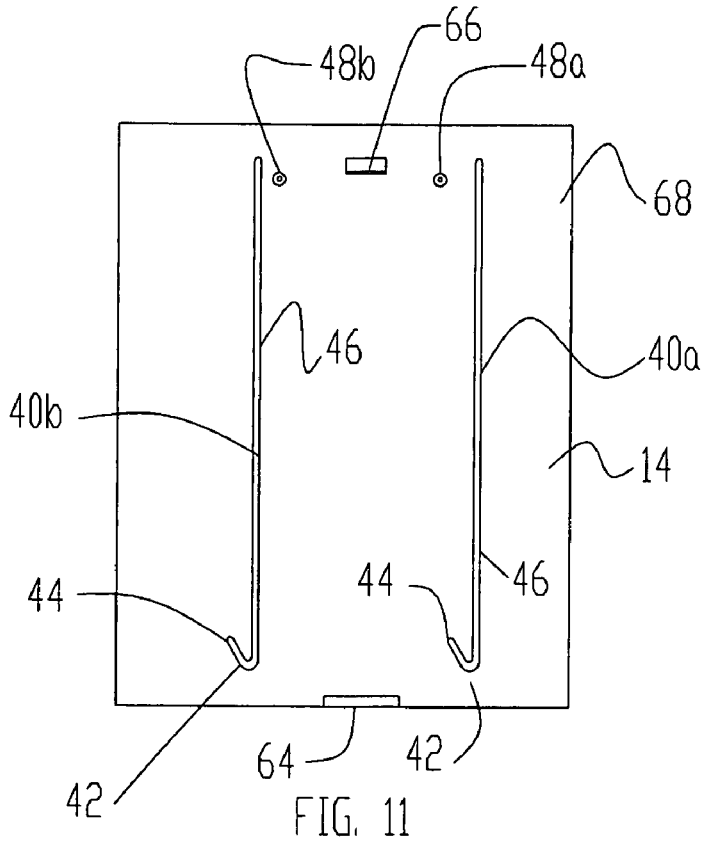
FIG. 11 is a rear elevation view of the slideable sign frame assembly shown in FIG. 10.
Figure 15:
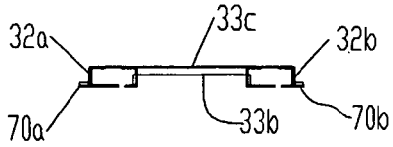
FIG. 15 is a cross-sectional view taken along the line 15-15 of FIG. 12.
Figure 16:
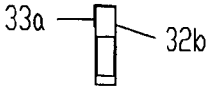
FIG. 16 is a cross-sectional view taken along the line 16-16 of FIG. 12.

With reference to FIGS. 1, 2 and 3, the sign 22 is sized to slide through the sign receiving slot 20 of the one retaining lip 18 of the back plate 14 and engage the sign retaining lips 16 at the front of the sign assembly 12. A sign change tool receiving member 64 is preferably centrally attached to the back 68 of the back plate 14 near the bottom thereof, as shown in FIGS. 7-11, and it may have a tubular configuration. A first angle stop member 66 is preferably centrally attached proximate the upper portion of the back 68 of the rigid back plate 14, as shown in FIGS. 7 and 8. The angle stop 66 may have an L-shaped cross-section, for example, and may be attached to the back plate 14 by a bolt, not shown.

Figure 17:
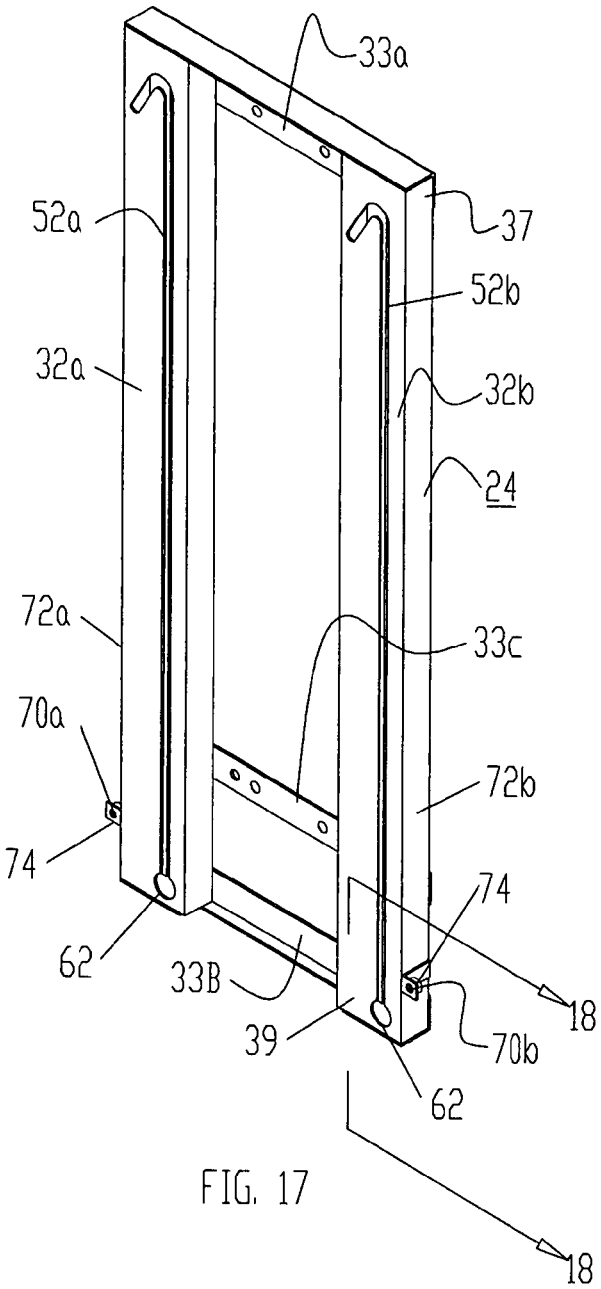
FIG. 17 is a perspective view of the sign frame assembly supporting apparatus.
Figure 18:
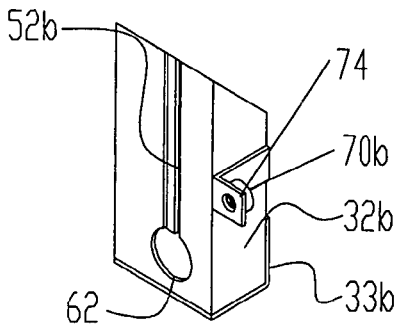
FIG. 18 is cross-sectional view taken along the line 18-18 of FIG. 17.
Figure 25:
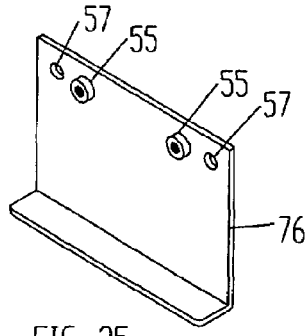
FIG. 25 is a perspective view of the third bracket.
Figure 26:
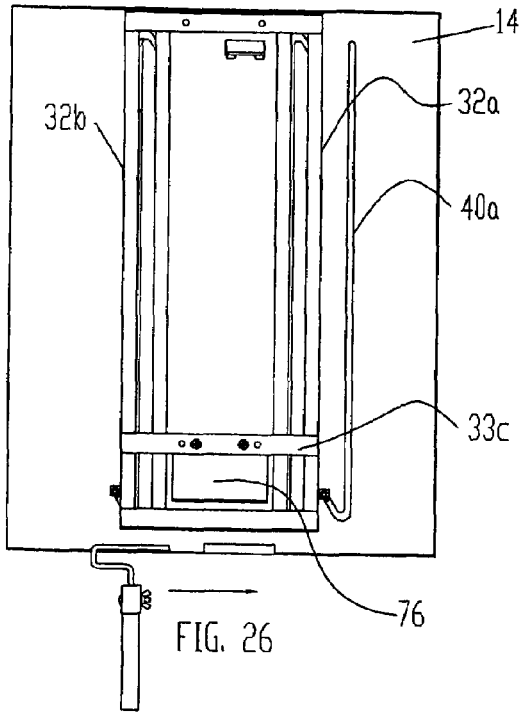
FIG. 26 is a rear elevation view of the sign system in the high display position; and, FIG. 27 is a plan view of the vertical pole mounting bracket shown in FIG. 23.
Figure 27:
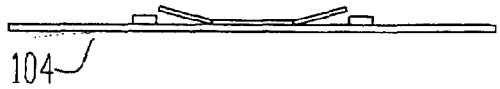

A pair of first bolt receiving members 70*a*, 70*b* are attached oppositely from one another, as shown in FIGS. 12 and 17, at the outer sides 72*a*, 72*b* of securing sections 32*a*, 32*b*, as shown in FIG. 17. Preferably, each of the first bolt receiving members 70*a*, 70*b* or tabs have first bolt apertures 74 therethrough as shown in FIG. 18. Preferably, the first bolt receiving members 70*a*, 70*b* are threaded proximate the apertures 74, not shown. Preferably, a second angle stop member 76 is operatively attached to the third bracket 33*c*, see FIGS. 3 and 25, by bolts 47 passing through the second angle stop 76 first apertures 55 which desirably are threaded, bolts 45 preferably pass through second stop 76 second apertures 57 and engage the wall 28. This arrangement provides for reliable retaining of the sign frame assembly when it is in the lowered change-out position.

Each of the first bolts 36 have a first pin portion 78 sized to slideably pass through the first bolt retaining and cooperating guide slots 40*a*, 40*b* and a first head portion 80 sized to prevent the first head portion 80 from passing through the slots 40*a*, 40*b*, as shown for example in FIG. 4. The first pin portions 80 of the first bolts 36 operatively engage the first bolt receiving members 70*a*, 70*b*, as shown in FIG. 3. First washers 82, preferably made of nylon, are inserted between members 70*a*, 70*b* and the back 68 of the back plate 14 and second washers 84 are also preferably inserted between bolts 36 and the front 86 of the back plate 14. The first and second washers 82 and 84 permit the back plate 14 to easily slide therebetween.

Each of the second bolts 38 have a second pin portion 88 sized to pass through one of the second bolt slots 52*a*, 52*b* and may be affixed to the back plate by welding or, in an alternative, for example, the second bolts may pass through one of said the back plate 14 is provided with second bolt receiving apertures 48*a*, 48*b*. The bolts 38 each have a second head portion 90 sized to prevent it from passing through the second bolt slots 52*a*, 52*b*. The second pin portion 90 of the second bolts 38 having threading, not shown, in the non-welded embodiment, to operatively engage a nut 92. The rigid back plate 14 may have a pair of second bolt receiving apertures 48*a*, 48*b* near the upper portion 50 of the back plate 14. The nut 92 may be sized to prevent it from passing through the second bolt receiving apertures 48*a*, 48*b*, of course, if the second bolts 38 are welded, for example, to the back plate, in proper alignment with the second bolt slots 52*a*, 52*b*, the nuts 92 and threading of the second pin portion 90 is not needed.

Figure 24:
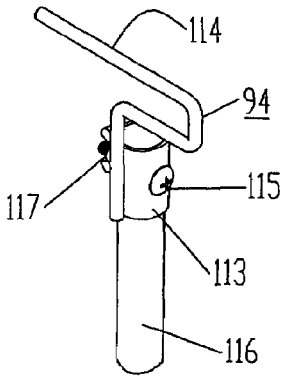
FIG. 24 is a perspective view of the upper portion of the sign change frame assembly engagement tool.

A sign change frame assembly engagement tool 94 is provided for operatively engaging the sign-change out tool receiving member 64, such as shown in FIGS. 1 and 24. Preferably, the sign change out tool 94 includes an upper U-shaped sign assembly engagement portion 114, an integral handle clamp 113, handle screw 115, wing nut 117, and a handle 116 of predetermined length such as 5 feet, attached to the U-shaped sign assembly engagement portion 114 of the tool. The length of the handle of course depends on the maximum height the bottom of the sign frame assembly is to be raised to attain the high display position.

Preferably, the sign frame assembly 12 also includes a slideable sign backing panel 96, as shown in FIG. 1, sized to slide through the sign receiving slot 20 and positioned adjacent to the back of sign 22. The backing panel 96 is preferably comprised of a flexible low friction plastic material, such as, corrugated polyurethane. Also, the sign frame assembly 12 desirably includes spacer members 98 of predetermined thickness such as 0.0625 inches. The spacer members 98 should be of such thickness to keep the backing panel 96 separated from back plate 14 to allow sufficient space so that the heads 80 of the first bolts 36 are permitted to move freely in slots 40*a*, 40*b* to prevent binding of bolts 36. The spacer members 98 may be made of pressure sensitive sponge pads, for example.

The sign frame assembly 12 in a preferred embodiment is provided with a windbreaker flap 100 attached to the one sign retaining lip 18 around the periphery of the sign receiving slot 20, as shown in FIG. 7, which as shown covers part of the opening of receiving slot 20. The windbreaker flap 100 may be made of a flexible material and prevents the sign from being dislodged during high winds if the sign assembly is mounted outdoors by substantially covering the slot 20.

The sign frame supporting apparatus 24 in another preferred embodiment is adapted for mounting to a vertical pole 102, such as shown in FIG. 23. A vertical pole mounting bracket 104 is provided and attached to the first bracket 33*a* and the third bracket 33*c* by first pole attachment bolts 106 passing through pole bracket apertures 110 and engaging pole apertures 112 which are desirably threaded. Second pole attachment bolts 108 are provided which engage first bracket 33*a* and third bracket 33*c* and the pole mounting bracket 104.

Figure 19:
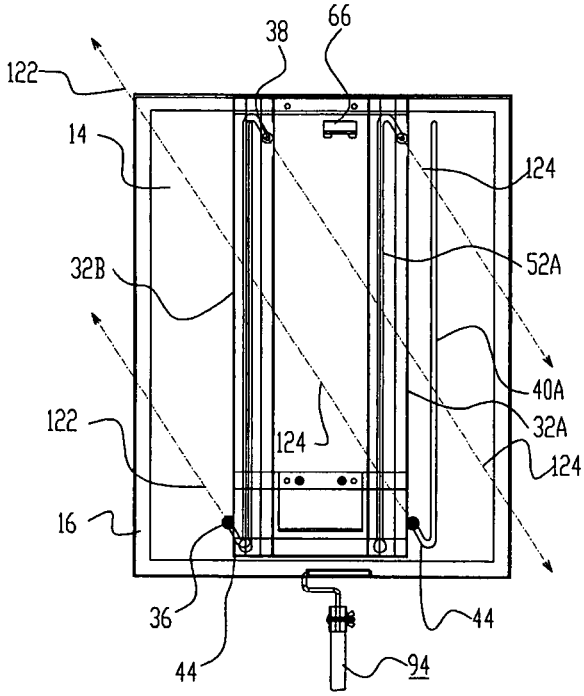
FIG. 19 is a rear elevation schematic view of the sign system of the present invention with the slideable sign frame assembly in the high display position.

Preferably, the length of the operative vertical portions 46 of the first slots 40*a*, 40*b* and the vertical portions 58 of the second slots are substantially equal. Preferably, the trough 118 of the V-shaped docking and locking portion 44 of the first slots 46 open in a upward direction to one side. The trough 120 of the inverted V-shaped docking and locking portions 56 of the second slots 52*a*, 52*b* opens in a downward direction to the side opposite the trough 118 of the V-shaped docking and locking portions 44 of the first slots 40*a*, 40*b*. Preferably, the locking portions 44 of the first slots and the locking portions 56 of the second slots are of equal length, such as 1 inch. With reference to FIG. 19, first parallel transverse planes 122 passing through the axes of the locking portions 44 of the first bolt retaining and guide slots 40*a*, 40*b* and second parallel transverse planes 124 passing through the axes of the locking portions 56 of the second slots 52*a*, 52*b* are configured, as part of the invention, such that planes 122 and 124 are also in parallel arrangement with respect to each other. This configuration allows the first slots 40*a*, 40*b* and second slots 52*a*, 52*b* to cooperate with one another to provide stability when lowering the sign 22 without any unwanted transverse swinging of the bottom of the sign assembly 12 or binding. In the preferred embodiment the first bolts 36 and first slots 40*a*, 40*b* and the second bolts 38 and the second slots 52*a*, 52*b* work in unison to accomplish a controlled and stable movement of the sign assembly 12 for safe and easy lowering the sign assembly 12.

Figure 20:
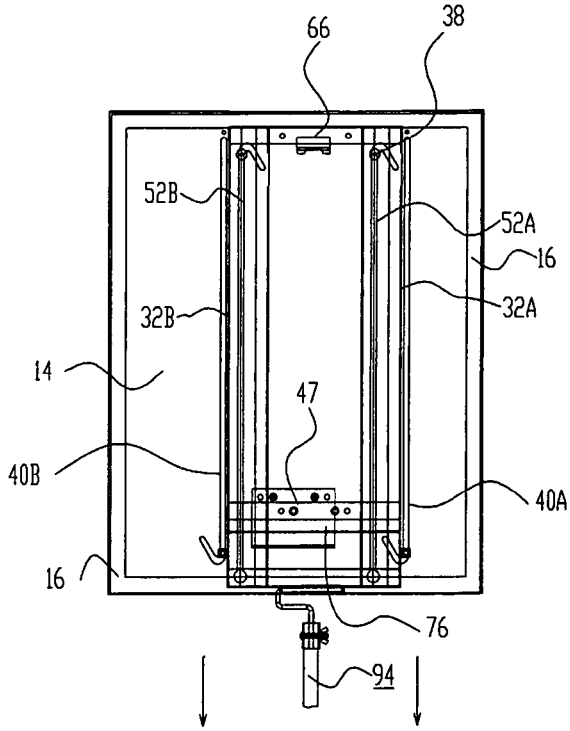
FIG. 20 is a rear elevation schematic view of the sign frame assembly showing the sign frame assembly raised into a position where the first bolts and the second bolts are in alignment with and just entering the respective vertical portions of the first and second bolt retaining and cooperating guide slots.
Figure 21:
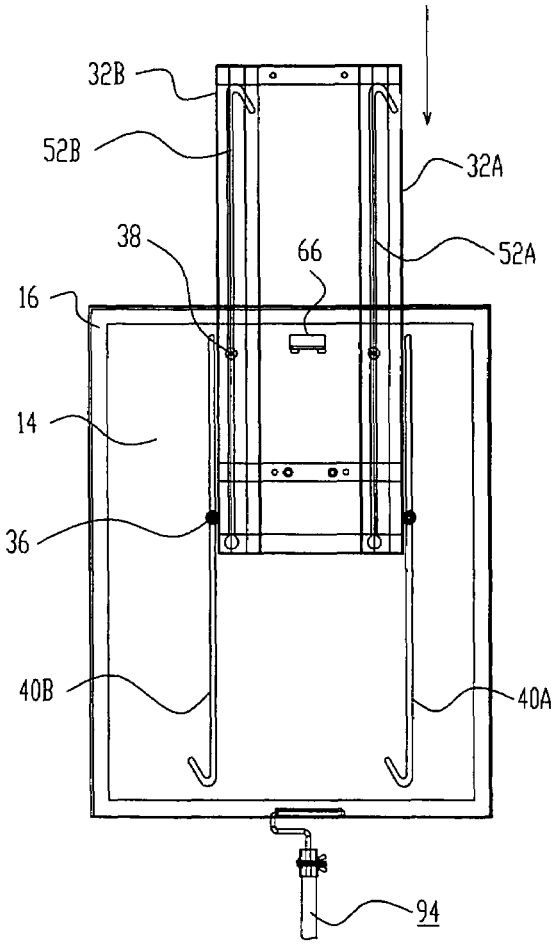
FIG. 21 is a rear elevation schematic view of the sign frame assembly lowered into a position about half way between the high display position and low change-out position and with the first bolts and second bolts are also about half way in the respective vertical portions of the first and second bolt retaining and cooperating guide slots.

The elevated sign system 10 of the present invention operates as follows: when it is desirous to change the sign 22 that is in the high display position, such as shown in FIGS. 1 and 19, where the sign frame supporting apparatus is substantially hidden, a person standing at ground level simply engages the sign change frame assembly engagement tool 94 with said sign change tool receiving member 64, which in this example is hollow, and with an upward force applied to said tool 94, the sign assembly is guided slightly by the arrangement of the cooperating arrangement of the locking portions 44, 56 of the first slots 40*a*, 40*b* and the second slots 52*a*, 52*b* to be raised initially about 1 inch to one side at a predetermined offset angle, such as 30 degrees from the vertical portions 46, 58 of the first slots 40*a*, 40*b* and second slots 52*a*, 52*b*, as it is raised by the cooperation of said V-shaped docking and locking portions of said first bolt retaining and cooperating guiding slots and second bolt retaining and cooperating guiding slots until the first bolts 36 are aligned with the vertical portions 46 of the first parallel sign frame supporting apparatus slots 40*a*, 40*b*, simultaneously with the second bolts 38 being aligned with the vertical portions 58 of the vertical sign frame receiving slots 52*a*, 52*b*, as shown in FIG. 20. Thereupon, the sign assembly 12 may be lowered. FIG. 21 shows the sign assembly 12 in a half way down lowered position. The sign assembly 12 of the present invention may be lowered with negligible transverse movement of sign 22 until first angle stop bumper member 66 of the sign frame assembly 12 contacts second angle stop bumper member 76 of the supporting apparatus 24 at the sign change-out position, as shown in FIGS. 2 and 22. Thereafter, the sign may be changed at a ground level height of 6 feet, for example, and upon change-out of the sign 22, the sign assembly 12 is manually raised with negligible transverse movement by using the tool 94 to raise the sign assembly 12 until the first bolts 36 and the second bolts 38 simultaneously are guided into said V-shaped docking and locking portions 42, 56 of the first 40*a*, 40*b* and second 52*a*, 52*b* cooperating slots to lock the sign frame assembly into the high display position by the force of gravity after the tool 94 is disengaged.

What is claimed is:

1. An elevated sign system having a high display position and low sign change-out position with safe and easy lowering capability and controlled stable movement, said sign system comprising:

a slideable sign frame assembly, including a rectangular rigid back plate, said rigid back plate having integral sign retaining lips proximate the periphery of said back plate extending from the front of the back plate, one of said sign retaining lips having a sign receiving slot therein;

a hidden sign frame assembly supporting apparatus to be affixed to a support, said sign frame assembly supporting apparatus including a pair of parallel vertical elongated hollow sign frame assembly securing sections space at a predetermined distance from each other, each of said sign frame assembly securing sections having a substantially rectangular cross-section, said sign frame securing sections of predetermined dimensions, sign frame securing section connecting and supporting means for connecting said sign frame assembly securing sections and providing support for said supporting apparatus;

attaching means for slideably attaching said slideable sign frame assembly to said sign frame assembly supporting apparatus, said attaching means including first bolts and second bolts;

said rigid back plate of said sign frame assembly having a pair of substantially vertical elongated parallel sign frame assembly first bolt retaining and cooperating guide slots therein, each of said sign frame assembly first bolt retaining and cooperating guide slots at the bottom thereof having a truncated V-shaped docking and locking portion, the locking portion of said V-shaped docking and locking portions of said first bolt retaining and guide slot upwardly retroverted at a predetermined angle from the vertical portion of said first bolt retaining and guide slot proximate the bottom of said first slot, each of said parallel vertical sign frame assembly securing sections having a substantially vertical elongated sign frame assembly second bolt retaining and cooperating guide slot therein of predetermined length, each of said sign frame assembly securing sections second bolt retaining and cooperating guide slots at the top thereof having an inverted truncated V-shaped docking and locking portions, the locking portion of the inverted V-shaped docking and locking portions of said second bolt retaining and guide slot of predetermined length and downwardly retroverted at said predetermined angle from the vertical portion of said second bolt retaining and guide slot proximate said the top of said second slot;

each of said sign frame assembly securing sections second bolt retaining and cooperating guide slots proximate the bottom thereof having a circular sign frame assembly second bolt insertion aperture;

a sign sized to slide through said sign receiving slot of said one retaining lip of said back plate and to engage said sign retaining lips proximate the front of said sign assembly;

a sign change tool receiving member centrally affixed proximate the bottom of said rigid back plate;

a first angle stop bumper member centrally affixed proximate the upper portion of the back of said rigid back plate;

a second angle stop bumper member operatively affixed to said sign frame securing section means, said second angle stop member for operatively contacting said first angle stop member;

a sign change frame assembly engagement tool means for operatively engaging said sign change-out tool receiving member;

whereby when it is desirous of changing a sign that is in the high display position, a person standing at ground level simply engages the sign change frame assembly engagement tool with said sign change tool receiving member, and with an upward force applied to said tool said sign assembly is guided slightly to one side at a predetermined offset angle from said first and second slots as it is raised by the cooperation of said V-shaped docking and locking portions of said first bolt retaining and cooperating guide slots and second bolt retaining and cooperating guide slots until said first bolts are aligned with the vertical portion of the parallel sign frame supporting apparatus slots simultaneously with said second bolts being aligned with the vertical portion of said vertical sign frame receiving slots, whereupon said sign may be lowered with negligible transverse movement of said sign until said angle stop bumper of said sign frame assembly contacts said angle stop member of said supporting apparatus at the sign change-out position, thereafter the sign may be changed at ground level height and upon change-out of the sign, the sign assembly is manually raised with negligible transverse movement by using said tool until said first bolts and said second bolts simultaneously are guided into said V-shaped docking and locking portions of said first and second cooperating slots to lock said sign frame assembly into said high display position and said tool is disengaged.

2. The elevated sign system of claim 1, wherein said attaching means further comprises a pair of first bolt receiving members affixed oppositely from one another proximate the outer sides of said sign frame assembly securing sections, each of said first bolt receiving members having first bolt receiving apertures therethrough, each of said first bolt receiving members being threaded proximate said first bolt receiving apertures, each of said first bolts having a first pin portion sized to pass through said first bolt retaining and cooperating guide slots proximate the front of said back plate and each of said first bolts having a first head portion sized to prevent the first head portion from passing through said first bolt retaining and guide slots, the first pin portions of said first bolts operatively engaging said threaded first bolt receiving members, each of said second bolts having a second pin portion sized to pass through one of said second bolt slots and having a second head portion sized to prevent said second head portion from passing through said second bolt slots, said second pin portion of said second bolts affixed proximate the end thereof to said backing plate in predetermined position.

3. The elevated sign system of claim 1, wherein said sign frame securing section connecting and supporting means includes a first bracket affixed between the top portions of said sign frame securing sections and the second bracket affixed between the bottom portions of said sign frame securing sections, a third bracket affixed between said sign frame securing sections proximate the lower portion thereof.

4. The elevated sign system of claim 3, wherein said second angle stop member is operatively affixed to said third bracket.

5. The elevated sign system of claim 1, wherein said sign frame assembly further includes a slideable sign backing panel sized to slide through said sign receiving slot and positioned adjacent to the back of said sign.

6. The elevated sign system of claim 5, wherein said sign frame assembly further comprises spacer members of predetermined thickness affixed to the back of said sign backing panel in predetermined position.

7. The elevated sign system of claim 1, wherein said sign change-out tool includes an upper U-shaped sign assembly engagement portion, a handle of predetermined length affixed to said U-shaped sign assembly engagement portion of said sign change-out tool.

8. The elevated sign system of claim 1, wherein the length of the operative vertical portions of said first bolt retaining and guide slots and the vertical portions of the second bolt retaining and guiding slots are substantially equal.

9. The elevated sign system of claim 1, wherein the trough of the V-shaped docking and locking portions of said first bolt retaining and guide slot open in a upward direction to one side and the trough of the V-shaped docking and locking portions of said second bolt retaining and guide slot open in a downward direction to the side opposite said trough of the V-shaped docking and locking portions of first bolt retaining and guide slot.

10. The elevated sign system of claim 1, wherein first transverse planes passing through the axes of the locking portions of said first bolt retaining and guide slots and second transverse planes passing through the axes of the locking portions of said second bolt retaining and guide slots are parallel to one another.

11. The elevated sign system of claim 1, wherein the locking portions of said second guide slots and the locking portions of said first guide slots are of equal length.

12. The elevated sign system of claim 1, wherein the locking portions of said first guide slots and locking portions of said second guide slots are at equal angles from the vertical.

13. The elevated sign system of claim 2, wherein said attaching means further includes first washer members of predetermined thickness carried by said first bolts.

14. The elevated sign system of claim 2, wherein said attaching means further includes second washer members of predetermined thickness carried by said first bolts.

15. The elevated sign system of claim 4, wherein said slideable sign backing panel is comprised of a flexible plastic material.

16. The elevated sign system of claim 1, wherein the sign frame assembly further includes a windbreaker flap affixed to said one sign retaining lip proximate the periphery of said sign receiving slot.

17. The elevated sign system of claim 1, wherein said support is a vertical wall.

18. The elevated sign system of claim 1, wherein said support is a vertical pole.

19. The elevated sign system of claim 18, wherein said sign frame supporting apparatus further comprises a vertical pole mounting bracket affixed to said first bracket and operably attaching said sign frame supporting apparatus to said vertical pole.

20. The elevated sign system of claim 1, wherein said predetermined angle of retrovertion of said first cooperating guide slot and second cooperating guide slot is from about 20 degrees to about 40 degrees from the vertical portions of said first cooperating guide slot and said second cooperating guide slot.

* * * * *